US007409803B2

(12) United States Patent
Grohman

(10) Patent No.: US 7,409,803 B2
(45) Date of Patent: Aug. 12, 2008

(54) HIDDEN DECK FASTENER SYSTEM

(75) Inventor: Martin Grohman, Biddeford, ME (US)

(73) Assignee: Correct Building Products, L.L.C., Biddeford, ME (US)

( * ) Notice: Subject to any disclaimer, the term of this patent is extended or adjusted under 35 U.S.C. 154(b) by 108 days.

(21) Appl. No.: 10/634,499

(22) Filed: Aug. 5, 2003

(65) Prior Publication Data

US 2005/0028473 A1 Feb. 10, 2005

(51) Int. Cl.
*E04B 5/00* (2006.01)

(52) U.S. Cl. ..... 52/489.1; 52/584.1; 52/586.1

(58) Field of Classification Search ..... 52/177, 52/650.3, 263, 506.06, 506.08, 582.1, 483.1, 52/489.1, 584.1, 586.1, 586.2, 480
See application file for complete search history.

(56) References Cited

U.S. PATENT DOCUMENTS 186,463 A * 1/1877 Dickinson ..... 52/512
363,960 A * 5/1887 Jensen ..... 52/512
1,714,738 A * 5/1929 Smith ..... 52/512
1,888,611 A * 11/1932 Wolfson ..... 52/512
2,362,252 A * 11/1944 Ellinwood ..... 52/288.1
4,169,340 A * 10/1979 Watson ..... 52/774
4,170,859 A * 10/1979 Counihan ..... 52/779
4,409,906 A 10/1983 Alneng
4,599,841 A * 7/1986 Haid ..... 52/396.04
4,603,528 A * 8/1986 Sigerist ..... 52/464
5,123,225 A * 6/1992 Goodworth ..... 52/506.08
5,355,648 A * 10/1994 Graver et al. ..... 52/506.08
5,394,667 A 3/1995 Nystrom
5,411,782 A 5/1995 Jarvis et al.
5,623,803 A 4/1997 Willis
5,647,184 A 7/1997 Davis
5,660,016 A * 8/1997 Erwin et al. ..... 52/483.1
5,836,128 A 11/1998 Groh et al.
5,850,720 A 12/1998 Willis
5,887,331 A 3/1999 Little
5,928,735 A 7/1999 Padmanabhan et al.
5,941,040 A * 8/1999 McAnallen et al. ..... 52/586.1
5,997,209 A 12/1999 Sachs
6,035,588 A 3/2000 Zehner et al.
6,199,340 B1 3/2001 Davis
6,314,699 B1 * 11/2001 West ..... 52/489.1
6,402,415 B1 6/2002 Eberle, III
6,423,257 B1 7/2002 Stobart et al.
6,453,630 B1 9/2002 Buhrts et al.

(Continued)

FOREIGN PATENT DOCUMENTS

CA 2418569 * 8/2004

OTHER PUBLICATIONS

Timber Tech, "A Revolutionary New Material," 1998, Crane Plastics Company, pp. 1-2.

(Continued)

*Primary Examiner*—Robert Canfield
(74) *Attorney, Agent, or Firm*—Hovey Williams LLP

(57) ABSTRACT

A deck system employing a plurality of substantially hidden fasteners to couple the floor boards of the deck to the joists. Each hidden fastener is rigidly coupled to a respective joist and positioned between a pair of adjacent floorboards. Each fastener forms a mating relationship with specially configured sides of the boards to thereby rigidly couple the boards to the joists.

20 Claims, 2 Drawing Sheets

U.S. PATENT DOCUMENTS

| | | | | |
|---|---|---|---|---|
| 6,470,641 | B1 * | 10/2002 | Faure | 52/480 |
| 6,484,467 | B2 * | 11/2002 | Crout | 52/483.1 |
| 6,586,504 | B1 | 7/2003 | Archuletta et al. | |
| 6,651,398 | B2 * | 11/2003 | Gregori | 52/489.1 |
| D485,373 | S | 1/2004 | Morton et al. | |
| 6,694,691 | B2 | 2/2004 | Ku | |
| 6,711,864 | B2 * | 3/2004 | Erwin | 52/582.1 |
| D488,373 | S | 4/2004 | Eberle | |
| 6,851,884 | B2 * | 2/2005 | Eberle | 403/231 |
| 6,871,467 | B2 | 3/2005 | Hafner | |
| 6,986,934 | B2 | 1/2006 | Chen et al. | |
| 7,073,303 | B2 * | 7/2006 | Baker | 52/586.1 |
| 2002/0059766 | A1 | 5/2002 | Gregori | |
| 2002/0121064 | A1 | 9/2002 | Erwin | |
| 2003/0123924 | A1 | 7/2003 | Eberle, III | |
| 2006/0283122 | A1 * | 12/2006 | Burgess et al. | 52/480 |

OTHER PUBLICATIONS

Christie Graham, "Plastic Composite Lumber," 1997, Architectural House Plans, pp. 1-4.

* cited by examiner

HIDDEN DECK FASTENER SYSTEM

RELATED APPLICATIONS

The present application is related to U.S. patent application Ser. No. 10/634,497, entitled "Grooved Decking Board," filed contemporaneously herewith, the entire disclosure of which is incorporated herein by reference.

BACKGROUND OF THE INVENTION

1. Field of the Invention

The present invention relates generally to decks. In another aspect, the invention concerns an improved deck system employing hidden fasteners to couple the floor boards of the deck to the supporting joists.

2. Description of the Prior Art

Conventional deck systems typically employ an elevated floor portion surrounded by a railing and supported by upright columns. The floor portion of the deck usually includes a number of laterally spaced supporting joists and a plurality of floor boards extending across and supported by the joists.

Traditionally, the floor of a deck has been constructed by nailing, stapling, or screwing the floor boards to the joists, while maintaining a slight gap between adjacent floor boards. Conventional methods of attaching the floor boards to the joists can be time consuming, and the conventional fasteners used to connect the floor boards to the joists can be unsightly. In addition, the conventional fasteners may loosen over time, thereby causing the floor boards to creak when walked over. Worse yet, a loosened fastener can protrude upwardly from the floor boards, thereby causing an unsightly and dangerous condition.

OBJECTS AND SUMMARY OF THE INVENTION

It is, therefore, an object of the present invention to provide an improved deck system employing a hidden fastener that is not visible from the top of the deck.

Another object of the invention is to provide an improved deck system which is less time consuming to construct than conventional deck systems yet conceals the fasteners.

A further object of the invention is to provide an improved deck system that prevents creaking of the floor boards on the joists.

Still another object of the invention is to provide an improved deck system that eliminates the possibility of having loosened fasteners extending above the floor boards of the deck.

Yet another object of the invention is to provide an improved method of constructing a deck.

It should be understood that the above-listed objects are only exemplary, and not all the objects listed above need be accomplished by the invention described and claimed herein.

Accordingly, in one embodiment of the present invention, there is provided a deck system comprising a plurality of laterally spaced joists, a plurality of boards extending across and supported by the joists, and a plurality of fasteners rigidly coupled to the joists and each presenting a pair of protrusions. Each of the boards defines a pair of longitudinally extending grooves on generally opposite sides of the board. Each of the protrusions of the fasteners is received in a respective groove of a respective board in a substantially complemental fashion.

In another embodiment of the present invention, there is provided a deck system comprising a plurality of laterally spaced joists, a plurality of boards extending across and supported by the joists, and a plurality of fasteners rigidly coupled to the joists and each presenting a pair of protrusions. Each of the boards presents a pair of similarly configured opposite sides. Each of the sides of the boards includes a pair of spaced-apart longitudinally extending lips presenting opposing inwardly facing surfaces. Each of the protrusions of the fasteners contacts both of the inwardly facing surfaces.

In a further embodiment of the present invention, there is provided a method of coupling a plurality of boards to a plurality of support members. The method comprises the steps of: (a) rigidly attaching a first fastener to one of the support members; (b) positioning a first board across the support member and against the first fastener to thereby form a mating relationship between the first board and the first fastener; (c) positioning a second fastener against the first board to thereby form a mating relationship between the first board and the second fastener; and (d) rigidly attaching the second fastener to the support member while maintaining the mating relationship between the first board and the first and second fasteners.

In yet another embodiment of the present invention, there is provided a board comprising an elongated body presenting a pair of similarly configured sides. Each of the sides presents a normally-upper lip and a normally-lower lip. Each of the sides includes a longitudinal groove defined between the normally-upper lip and the normally-lower lip. The groove includes an inner-most surface representing the deepest portion of the groove. The normally-upper lip extends further from the inner-most surface than the normally-lower lip.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
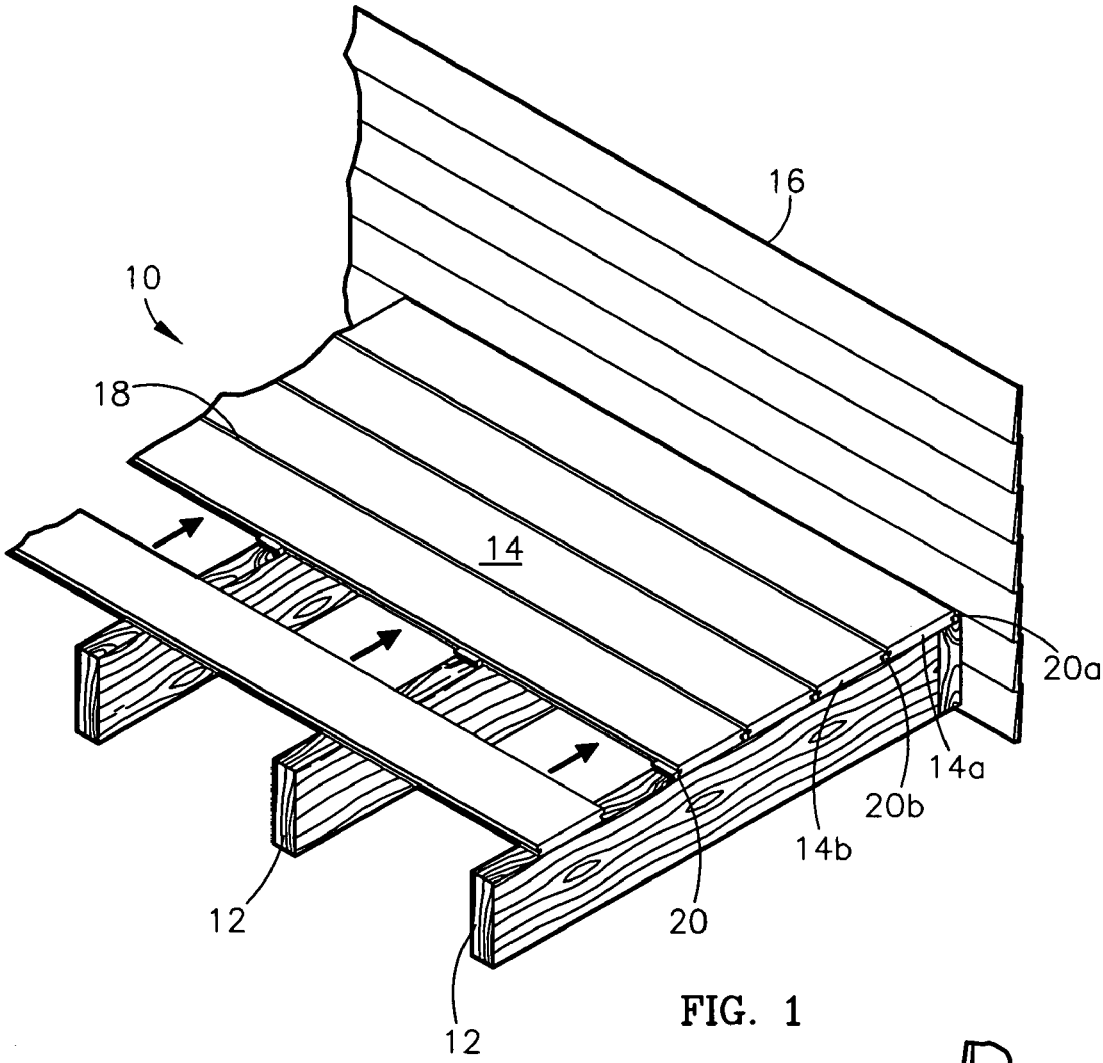
FIG. 1 is an isometric view of a deck system being constructed in accordance with the principles of the present invention, particularly illustrating the manner in which a plurality of hidden fasteners are positioned between adjacent floor boards of the deck and used to couple the floor boards to the joists.

Referring initially to FIG. 1, an inventive deck system 10 is illustrated as including a plurality of joists 12 which support a plurality of boards 14. Joists 12 are coupled to and extend outwardly from a wall 16. Joists 12 can be supported in an elevated position by a plurality of generally upright support columns (not shown). Joists 12 are typically wooden or composite boards oriented on their sides to thereby provide sufficient structural support. Joists 12 are laterally spaced from one another and extend substantially parallel to one another. A typical spacing between joists 12 is sixteen to twenty-four inches. Boards 14 extend across, lie flat on, and are coupled to joists 12. Boards 14 typically extend substantially parallel to one another and substantially perpendicular to joists 12. It is preferred for a gap 18 to be maintained between adjacent boards 14. In a preferred embodiment of the present invention, boards 14 are formed of composite cellulosic (e.g., wood, paper, rice hulls etc.,) fiber and plastic; however, it is within the ambient of the present invention for boards 14 to be conventional wooden boards.

Figure 2:
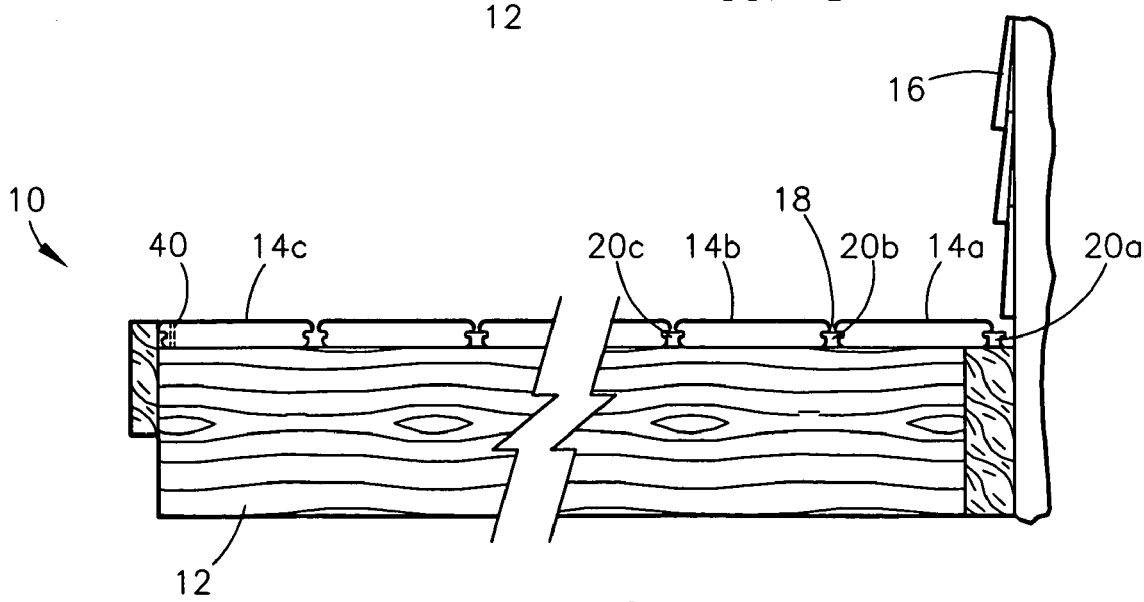
FIG. 2 is a partial side view of a deck system constructed in accordance with the principles of the present invention.

Referring to FIGS. 1 and 2, boards 14 are coupled to joists 12 via a plurality of hidden deck fasteners 20. Each fastener 20 is disposed between a pair of adjacent boards 14 and is rigidly coupled to a joist 12. Each fastener 20 forms a mating relationship with each of the boards between which the fastener 20 is disposed. As used herein, the term "mating relationship" shall denote a physical interrelationship between two components wherein a protrusion of one component is received in an opening of the other component. The mating relationship formed between fasteners 20 and boards 14 rigidly couples boards 14 to joists 12 via fasteners 20.

Figure 3:
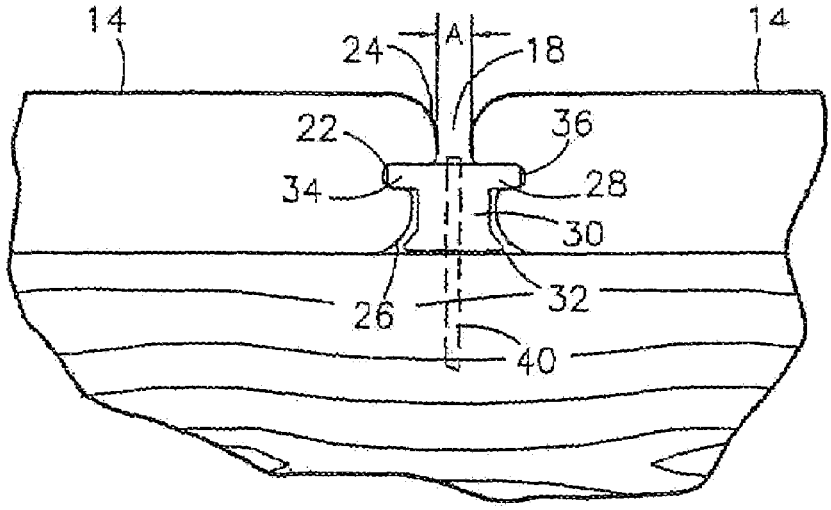
FIG. 3 is an enlarged partial side view of a hidden fastener disposed between two adjacent floor boards of a deck, particularly illustrating the manner in which a pair of protrusions of the fastener forms a substantially complemental mating relationship with grooves formed in the sides of the adjacent floor boards.

Referring to FIG. 3, each side of each board 14 is similarly configured to include a longitudinal groove 22 defined between an upper lip 24 and a lower lip 26. Each fastener 20 includes a broad head 28, a narrowed mid-section 30, and a flared base 32. Broad head 28 includes a pair of similarly configured projections 34,36. As shown in FIG. 3, broad head 28 is received between adjacent boards 14 in a manner such that each projection 34,36 is received in a respective groove 22 in a substantially complemental fashion. As used herein, the term "complemental fashion" shall denote a manner of interfitting two components wherein a projection of one component substantially fills the void of another component (i.e., fills at least 60 percent of the void in the other component). Preferably, each projection 34,36 fills at least 75 percent of a respective groove 22 in a respective board 14, more preferably projections 34,36 fill at least 85 percent of a respective groove 22, and most preferably projections 34,36 at least 95 percent of a respective groove 22. The complemental relationship between protrusions 34,36 and grooves 22 inhibits shifting of boards 14 relative to fastener 20.

Figure 4:
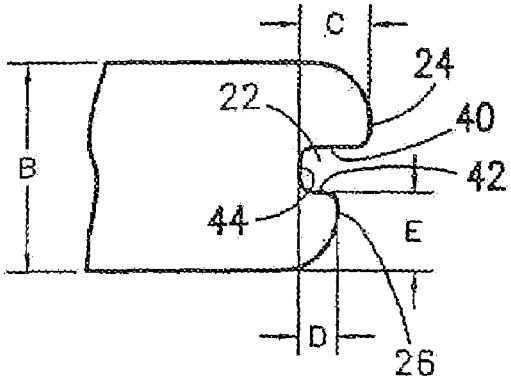
FIG. 4 is an enlarged partial end view of a board constructed in accordance with the principles of the present invention, particularly illustrating a side of the board which includes an upper lip, a lower lip, and a longitudinally extending groove defined between the upper and lower lips.

Referring to FIGS. 3 and 4, upper and lower lips 24,26 of board 14 present opposite inwardly facing surfaces 40,42 which define at least a portion of groove 22. As shown in FIG. 3, when protrusion 34 is received in groove 22, protrusion 34 is received between and contacts both inwardly facing surfaces 40,42. This contact between protrusion 34 and surfaces 40,42 prevents upward or downward movement of board 14 relative to fastener 20. It is preferred for the distance between surface 40 and surface 42 (i.e., the width of groove 22) to be in the range of from about 0.05 to about 0.5 inches, more preferably from about 0.1 to about 0.3 inches, and most preferably from 0.15 to 0.25 inches. Referring again to FIG. 4, groove 22 also includes an inner-most surface 44 which represents the deepest portion of groove 22. It is preferred for upper lip 24 to extend further from inner-most surface 44 than lower lip 26. More preferably, upper lip 24 extends at least about ten percent further from inner-most surface 44 than lower lip 26, still more preferably at least about twenty percent further, and most preferably at least thirty percent further. As shown in FIG. 4, this configuration allows broad head 28 of fastener 20 to be received between boards 14 while maintaining a minimal gap 18 between the upper lips 24 of boards 14, thereby substantially hiding fastener 20 under upper lips 24. Further, this configuration allows for the use of a fastener 20 having a flared base 32, which permits the fastener to stand up on the joist 12 without additional external support.

Figure 5:
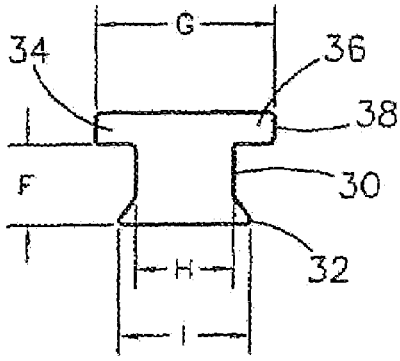
FIG. 5 is an end view of a hidden deck fastener constructed in accordance with the principles of the present invention.
Figure 6:
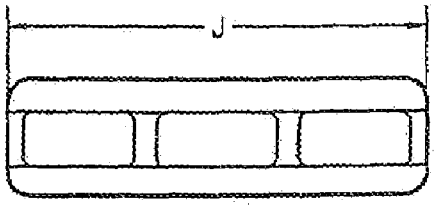
FIG. 6 is a side view of the hidden deck fastener shown in FIG. 5.

Referring to FIGS. 3 through 5, various dimensions (A-J) of boards 14 and fasteners 20 are provided below in Table 1. These dimensions are provided in preferred, more preferred, and most preferred ranges; however, it should be understood that the present invention is not limited by these dimensions unless a dimension is expressly recited in the claims.

TABLE 1

| Dimension | Preferred Range (inches) | More Preferred Range (inches) | Most Preferred Range (inches) |
|---|---|---|---|
| A | 0.1-0.75 | 0.15-0.5 | 0.2-0.3 |
| B | 0.5-2 | 0.75-1.5 | 0.9-1.25 |
| C | 0.2-0.75 | 0.25-0.5 | 0.3-0.4 |
| D | 0.05-0.5 | 0.1-0.3 | 0.15-0.25 |
| E | 0.2-0.75 | 0.25-0.5 | 0.35-0.4 |
| F | 0.2-0.75 | 0.25-0.5 | 0.3-0.4 |
| G | 0.25-2 | 0.4-1.5 | 0.6-0.9 |
| H | 0.2-0.75 | 0.25-0.5 | 0.35-0.4 |
| I | 0.2-1.0 | 0.4-0.8 | 0.5-0.7 |
| J | 0.5-6 | 0.75-3 | 1-2.5 |

Referring to FIGS. 4 and 5, it is particularly preferred for the thickness (E) of lower lip 26 to be slightly greater than the height (F) of protrusions 34,36. Preferably, the thickness (E) of lower lip 26 is at least about one percent greater than the height (F) of protrusions 34,36, more preferably at least about two percent greater, and most preferably at least five percent greater. Having the thickness (E) of lower lip 26 greater than the height (F) of protrusions 34,36 ensures that when projections 34,36 of fastener 30 are inserted into a respective groove 22 of a respective board 14, projections 34,36 exert a downward holding force on lower lip 26 of board 14. This downward holding force exerted by projections 34,36 on lower lip 26 inhibits upward movement of board 14 relative to fastener 20 and joist 12. Preferably, fastener 20 is made of a resilient material that allows projections 34,36 to be elastically flexed when projections 34,36 are inserted into a respective groove 22. The flexure of projections 34,36 can then exert and maintain the downward holding force on lower lip 26. Preferably, fastener 20 is formed of a resilient synthetic resin material such as, for example, polypropylene. It is also possible that having a thickness (E) of lower lip 26 greater than the height (F) of protrusions 34, 36 can cause a staple 40 (shown in FIG. 3) to pull slightly out of joist 12 when projections 34, 36 of fastener 30 are inserted into a respective groove 22 of a respective board 14. This "pulling-out" of staple 40 should not cause staple 40 to work loose over time due to the tendency of staples to splay and wander as they penetrate wood.

Referring to FIGS. 3 through 5, in order to maintain a gap 18 of proper width (A) between adjacent boards 14, the width (H) of mid-section 30 can be set so that when mid-section 30 is sandwiched between and contacts lower lip 26 of two adjacent boards 14, a proper gap 18 is formed. In addition, or alternatively, gap 18 can be maintained at a proper width (A) by insuring that head 28, which can be sandwiched between and maintained in contact with inner-most surfaces 38 of adjacent boards 14, has a proper width (G). It is preferred for the width (G) of head 28 to be at least about 105 percent greater than the distance (C) that upper lip 24 projects from inner-most surface 38 of groove 22. Most preferably, the width (G) of head 28 is at least 110 percent greater than the distance (C) that upper lip 24 projects from inner-most surface 38 of groove 22. It is also preferred for the maximum width (G) of head 28 to be at least about twenty-five percent greater than the minimum width (H) of mid-section 30, most preferably at least forty percent greater than the minimum width (H) of mid-section 30. It is further preferred for the maximum width (G) of head 28 to be at least about ten percent greater than the maximum width (I) of flared base 32, most preferably at least twenty percent greater than the maximum width (I) of flared base 32.

Referring to FIGS. 1, 2, and 3, in order to construct deck system 10, a first row of fasteners 20*a* is rigidly coupled to joists 12 proximate wall 16. Fasteners 20*a* can be rigidly coupled to joists 12 via any conventional means known in the art such as, for example, stapling, nailing, and/or screwing. In order to facilitate the speed with which deck system 10 is constructed, it is preferred for fasteners 20 to be coupled to joists 12 by extending a staple 40 (shown in FIG. 3) downwardly through the middle of fastener 20. After the first row of fasteners 20*a* has been coupled to joists 12, a first row of boards 14*a* can be laid across joists 12 and adjacent the first row of fasteners 20*a*. The first row of boards 14*a* can then be shifted into a mating relationship with fasteners 20*a*. When the first row of boards 14*a* is shifted into the mating relationship with fasteners 20*a*, a protrusion of fastener 20*a* is forced into a longitudinal groove of boards 14*a*. As discussed above, it is preferred for the insertion of the protrusion of fasteners 20*a* into the longitudinal groove of boards 14*a* to cause flexure of the protrusion of fastener 20*a*. Thus, it may be necessary to use a tool, such as a rubber mallet, to tap board 14*a* into the mating relationship with fastener 20*a*. After the first row of boards 14*a* has been positioned in a mating relationship with the first row of fasteners 20*a*, a second row of fasteners 20*b* can be positioned into a mating relationship with the groove formed on the opposite side of boards 14*a*. Once the fasteners 20*b* of the second row have been properly positioned, fasteners 20*b* can be rigidly coupled (preferably stapled) to joists 12. This coupling of fasteners 20*b* to joists 12 preferably causes flexure of the protrusion of fasteners 20*b* within the elongated slot of board 14*a*. When this has been done, boards 14*a* are received between the first and second rows of fasteners 20*a*,20*b* and are rigidly coupled to joists 12 via fasteners 20*a*,20*b*. A second row of boards 14*b* can then be positioned into a mating relationship with the opposite side of the second row of fasteners 20*b*. The second row of boards 14*b* can then be fixed in place by rigidly coupling a third row of fasteners 20*c* to joists 12 in a mating relationship with the opposite side of boards 14*b*. The above-recited steps can be sequentially repeated for all boards 14 and fasteners 20 of deck system 10. However, the terminal board 14*c* (shown in FIG. 2) may need to be coupled to joists 12 via a more conventional means, such as by inserting a screw through pre-drilled holes 40 in board 14*c*.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventor hereby states his intent to rely on the Doctrine of Equivalents to determine and assess the reasonably fair scope of the present invention as it pertains to any apparatus not materially departing from but outside the literal scope of the invention as set forth in the following claims.

What is claimed is:

1. A deck system comprising:

a plurality of boards operable to extend across a plurality of laterally spaced joists, each of said boards presenting an upper lip and a lower lip, said upper and lower lips defining a pair of longitudinally extending grooves on generally opposite sides of the board, said lower lip having a thickness "E"; and a plurality of generally T-shaped fasteners each operable to rigidly couple to the joists, each of said fasteners presenting a generally solid base including a lower joist-engaging surface for engaging the joists and a pair of protrusions each having a bottom surface that is spaced vertically upward from and substantially parallel to the joist-engaging surface, said bases presenting waist portions defining generally uniform gaps between said boards, each of the protrusions extending generally perpendicularly from a vertical axis of the fastener, each of said protrusions further operable to be received in a respective groove of a respective board in a substantially complemental fashion, wherein an average vertical distance "F" is defined between the joist-engaging surface and at least a portion of the bottom surface of the protrusion, wherein said at least a portion of the bottom surface of the protrusion is closer to the waist portion than to the distal end of the protrusion and "E" is at least 1% greater than "F" along said at least a portion of the bottom surface of the protrusion, such that the joist and the at least a portion of the bottom surface of the protrusion cooperatively exert a compressive force on the lower lip when the joist-engaging surface engages the joist and the protrusion is received in a respective groove of a respective board in a substantially complemental fashion.

2. The system of claim 1, wherein "E" is at least about 2% greater than "F".

3. The system of claim 2, wherein "E" is at least about 5% greater than "F."

4. The deck system of claim 1, wherein the protrusions exert a downward holding force on the lower lips when the protrusions are at least partially received within the grooves.

5. The deck system of claim 4, wherein the downward holding force is due to the thickness of the lower lips being at least 1% greater than the height of the protrusions.

6. The deck system of claim 4, wherein the downward holding force inhibits upward movement of the boards relative to the fasteners and joists.

7. The deck system of claim 4, wherein the fasteners are comprised of a resilient material that allows the protrusions to be elastically flexed when the protrusions are at least partially received within the grooves.

8. The deck system of claim 7, wherein the flexing of the protrusions facilitates maintaining the downward holding force on the lower lips.

9. The deck system of claim 1, wherein the fasteners securely couple the boards to the joists when the protrusions are at least partially received within the grooves.

10. The system of claim 1, wherein the fasteners are operable to be rigidly coupled with the joists utilizing a fastening element and the gap between two of the boards is greater than the maximum lateral dimension of the fastening element.

11. A method of coupling a plurality of boards to a plurality of support members, the method comprising the steps of:

(a) rigidly attaching a first generally T-shaped fastener to a first support member, the first fastener having a base including a lower support member engaging surface engaging the support member and at least one protrusion, the protrusion extending generally perpendicularly from a vertical axis of the fastener and presenting a bottom surface that is substantially parallel to the lower support member engaging surface;

(b) positioning a first board across the first support member and against the rigidly-attached first fastener such that the protrusion of the first fastener is at least partially received in a first longitudinal groove of the first board to form a mating relationship between the first board and the first fastener, wherein the positioning of the first board and the first fastener in the mating relationship causes the protrusion of the first fastener to flex and exert a first downward holding force on the first board, wherein the longitudinal groove is generally defined by a upper lip and a lower lip, the first holding force is exerted against the lower lip by at least a portion of the protrusion that is closer to the vertical axis of the fastener than to the distal end of the protrusion, and the vertical thickness of the lower lip is at least 1% greater than the average vertical distance from the support member engaging surface of the base to the bottom surface of the protrusion at said at least a portion of the protrusion;

(c) positioning a second fastener against the first board such that a protrusion of the second fastener is at least partially received in a second longitudinal groove of the first board to form a mating relationship between the first board and the second fastener;

(d) rigidly attaching the second fastener to the first support member while maintaining the mating relationship between the first board and the first and second fasteners, the second fastener being rigidly attached to the first support member after the second fastener is positioned against the first board; and (e) positioning a second board across the first support member and against the second fastener to thereby form a mating relationship between the second board and the second fastener, the second fastener being disposed generally between the first and second boards and causing a generally uniform gap to be maintained between the first and second boards.

12. The method of claim 11, wherein the first holding force inhibits movement of the first board relative to the first fastener and the first support member.

13. The method of claim 11, wherein the first holding force holds the first board against the first support member.

14. The method of claim 11, wherein rigidly attaching the second fastener to the first support member causes the protrusion of the second fastener to flex and exert a second downward holding force on the first board.

15. The method of claim 14, wherein the first and second holding forces are exerted on generally opposite sides of the first board.

16. The method of claim 14, wherein the first and second holding forces hold the first board against the first support member.

17. The method of claim 14, wherein the first and second holding forces securely couple the first board to the first support member.

18. The method of claim 11, wherein the thickness of the lower lip is at least 2% greater than the average vertical distance from the base to the protrusion.

19. The method of claim 18, wherein the thickness of the lower lip is at least 5% greater than the average vertical distance from the base to the protrusion.

20. The method of claim 14, wherein the holding force inhibits movement of the boards relative to one another, movement of the support members relative to one another, and movement of the boards relative to the support members, thereby forming a more rigid deck system than if the holding force were not present.

* * * * *